United States Patent [19]

Bachmann et al.

[11] Patent Number: 4,606,792

[45] Date of Patent: Aug. 19, 1986

[54] ENDLESS SIEVE BAND OR COMPOSITE BAND FOR PAPER MACHINES

[75] Inventors: Wolfgang Bachmann, Dreieich-Sprendlingen; Dieter Spahn, Hanau, both of Fed. Rep. of Germany

[73] Assignee: Roda Holding Anstalt, Vaduz, Liechtenstein

[21] Appl. No.: 513,986

[22] Filed: Jul. 14, 1983

[30] Foreign Application Priority Data

Nov. 25, 1982 [DE] Fed. Rep. of Germany ..... 3243512

[51] Int. Cl.[4] ..... D21F 1/10; D21F 1/32

[52] U.S. Cl. ..... 162/232; 139/383 A; 162/348; 162/358; 162/DIG. 1; 428/222

[58] Field of Search ..... 162/232, 348, DIG. 1, 162/290, 358; 139/383 A; 428/222, 224

[56] References Cited

U.S. PATENT DOCUMENTS 3,915,202 10/1975 Curtis ..... 162/348
4,290,209 9/1981 Buchanan et al. ..... 139/383 A
4,395,308 7/1983 Dawes ..... 139/383 A

FOREIGN PATENT DOCUMENTS 2419751 4/1974 Fed. Rep. of Germany .

OTHER PUBLICATIONS

"Paper Machine Felts and Fabrics", Albany International; 1976, pp. 33–34.

*Primary Examiner*—Steve Alvo
*Attorney, Agent, or Firm*—Michael J. Striker

[57] ABSTRACT

An endless sieve band or composite band for paper machines and the like, has a plurality of helixes composed of an elastic wire and each having two opposite winding legs and also two head curves connecting the winding legs with one another and having a predetermined wire diameter and wire width, wherein the helixes are arranged so that when the head curve of one of two neighboring helixes is inserted into an intermediate space of another of the two neighboring helixes an overlapping region is formed into which an insertion wire is introduced, and the winding legs of each of the helixes include a supporting winding leg which has flat supporting sufaces with a width exceeding the wire diameter or the wire width of the head curves.

29 Claims, 10 Drawing Figures

FIG. 6
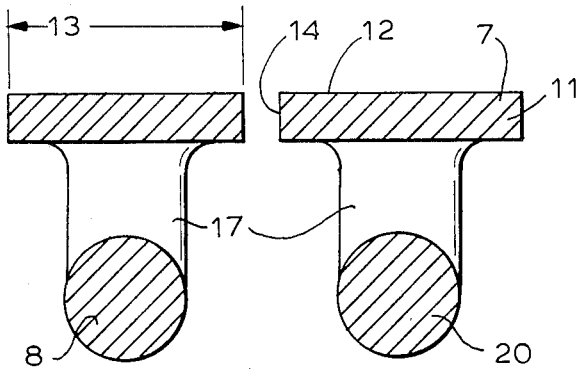
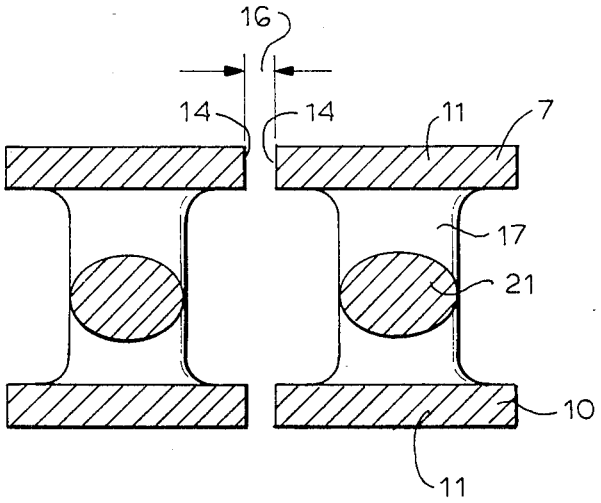
FIG. 7

FIG. 9
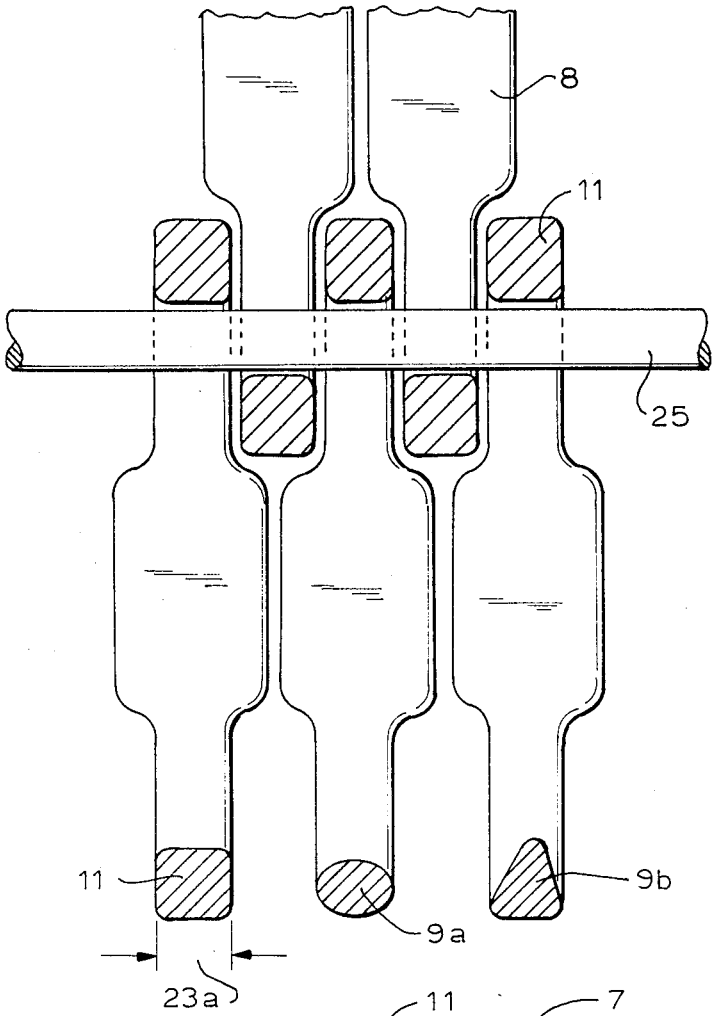
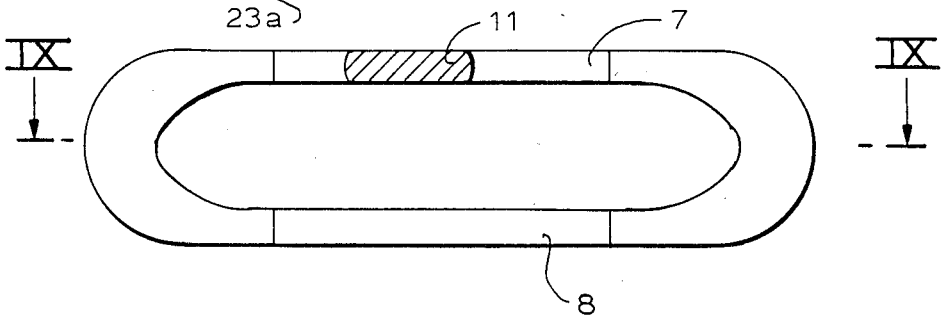
FIG. 10

ENDLESS SIEVE BAND OR COMPOSITE BAND FOR PAPER MACHINES

BACKGROUND OF THE INVENTION

The present invention relates to a an endless sieve band or composite band for paper machines, or the like.

Sieve bands or composite bands of the above mentioned general type are known in the art. A known band has a plurality of helixes of elastic synthetic or metallic wire and including opposite winding legs and head curves connecting the latter with one another. A head curve of the neighboring helix is inserted into an intermediate space of its helix so that, between both helixes an overlapping region takes place, and an insertion wire of synthetic plastic material or metal is inserted in this region. Such a band is disclosed, for example, in the German Pat. No. 2,419,751 and in the German Offenlegungsschrift No. 2,938,221. The wire helixes of the band disclosed in this first reference has a pulling spring-like tensioning so as to contract the respective neighboring wire helix. Such a wire composite band must elastically maintain in operation its dimensions, particularly in the transverse direction. Furthermore, the technical progress of such a wire composite band is that its manufacture is simplified so that during their insertion into one another the helixes forcibly find their place and are clamped relative to one another; therefore, expensive arrangements can be avoided and the connecting means need no longer be rigid and heavy. In the case of the above mentioned Offenlegungsschrift, it is provided that the helixes have no pulling-spring-like tensioning and the wire of the helixes is torsion-free. The service life of the flat shaped article of this reference must be increased, and the marking mobility must be guaranteed. These different, practically contradictory requirements lead to flat shaped articles which are used in many fields. After a certain time it has, however, been shown that these bands possess characteristics which can be improved. Because of the mainly round or slightly oval identical cross sections of the wire forming the helixes, the bands have an extremely high air permeability. In many cases it is desirable, however, during the manufacture of paper, this often leads to fluttering of paper. In order to eliminate this problem, additional filling elements are introduced into the helixes of elastic synthetic plastic or metallic wire, in addition to the connecting means such as insertion wires. This permits to influence the air permeability, but includes a considerable degree of labor expense to insert into the helixes the respective parts, such as insertion wires or cotton-synthetic plastic filling means. Moreover, material consumption and selling price increase.

A further characteristic of the known sieve bands or composite bands is the so-called point contact between the supporting winding legs and, for example, the paper. Depending upon the weight and quality of the paper and the applied pressure during the manufacture of paper, this leads to impressing the winding layers onto the finished paper. Although this impression is desired, for example, for manufacture of patterns, during the manufacture of high quality smooth papers such impressions must be avoided. The point-like or edge-like contact between the supporting winding legs of the helixes and the paper leads to another characteristic of the known flat shaped articles, namely to a weak heat flow between the calender roller and the paper because of only small supporting possibilities, and thereby required small contact surfaces. This leads to the fact that the supporting winding leg possesses greater contact surfaces with the paper, whereby the danger of marking on the supporting point and the supporting edges is smaller and the heat flow is improved. However, a higher air permeability of the band must be taken into account, inasmuch as the distance between the individual windings of the helixes is greater. For reducing this air permeability, sealing guides and sheet inserts are introduced in the known flat shaped articles, extending in the longitudinal direction of the helixes or also in the intermediate spaces between the neighboring winding legs.

SUMMARY OF THE INVENTION

Accordingly, it is an object of the present invention to provide an endless sieve band or a composite band for paper machines, which avoids the disadvantages of the prior art.

More particularly, it is an object of the present invention to provide, such as a sieve band or a composite band for paper machines, which combines the advantages of easy manufacture from round wire helixes with the advantages of large supporting surfaces and high heat transfer and a limited air permeability.

In keeping with these objects and with others which will become apparent hereinafter, one feature of the present invention resides, briefly stated, in an endless sieve band or composite band in which supporting winding legs of the helixes has flat supporting surfaces with a width which is greater than the wire diameter or the wire width of the head curve.

When the band is designed in accordance with the present invention it is equally easy, or even easier, to assemble the helixes so as to form the band, than in the case of helixes from round wire. For automatic manufacture of the band on manufacturing (jointing) machines, only a spiral dimension must be provided. In other words, practically automatic manufacturing (jointing) machines can produce bands with only one helix dimension without problems. In addition, the manual production is simpler and easier, inasmuch as the helixes to be used are more accurate and smoother than the previously utilized helixes.

The intermediate spaces between the individual winding legs can be greater or smaller, as desired. Not only advantageous flat receiving surfaces of the supporting winding leg is obtained, but also an air stream with desired strength without disadvantageous introduction of filling means between the winding legs or inside the helixes. Also, the heat transfer, for example from calender rollers through the flat shaped article to the paper is improved. Comparable advantages are obtained only in the event of numerous further applications of the flat shaped article in accordance with the present invention, for example as a sieve band. By the width of the winding leg and the dimensions of the intermediate spaces in the entire flat shaped article depending thereon, it is possible to vary the air permeability between an approximately closed entire supporting surface and one which is formed from supporting winding legs whose width is only insignificantly greater than the diameter or the width of the head curves.

In accordance with one embodiment of the invention, the sieve band or composite band is formed so that the winding leg which is opposite to the winding leg carrying the flat supporting surfaces has a round, oval or triangle-like cross section. The air permeability is thereby influenced only by the supporting winding leg.

A further possibility to vary the air permeability with a good support for the paper is provided when both winding legs connected by a head curve have flat supporting surfaces. Therefore the air stream encounters a greater resistance than in the first embodiment.

In accordance with the present invention, the wire of the head curves of the helixes can be composed of substantially round, oval, triangle-like or rectangle-like cross section which is squeezed relative to its initial design, and the winding leg which has the flat supporting surfaces has an approximately rectangle-like cross section. Therefore, a sieve band or composite band is formed which satisfies all requirements in the sense of its assembly, pivotability, air permeability, supporting surfaces, and its heat transfer from calender rollers to paper.

In the band in accordance with a further embodiment, the width of the winding leg having the flat supporting surfaces is greater, up to double, the wire diameter and the wire width of the head curves.

The helixes of the proposed band are wound with a spacing so that the helixes have a pulling-spring-like tensioning which fixes the intermediate spaces between its head curves, but is greater than its wire diameter or its wire width. As a result of this, the head curves of the neighboring helixes do not abut against one another despite the fact that the helixes have a pulling-spring-like tensioning.

Further advantages and possibilities of variations are provided when the endless sieve band or composite band in accordance with the present invention has alternating right-sided and left-sided helixes. Without changing the main idea of the present invention, all helixes of the band of the invention can be formed as right-sided or left-sided, exclusively.

Although the distance between the head curves of the helixes is greater than the width or the diameter of the head curve wires, the helixes can be reinforced before the manufacture in collecting containers without hooking against one another.

In accordance with still a further embodiment of the invention, the winding leg forms with the insertion wire an angle which is different from 90°, whereas the head curves of the helixes form with the insertion wires an angle which is substantially equal to 90°.

The endless sieve band or composite band in accordance with the present invention can be formed so that the edges of the winding legs having the flat supporting surfaces abut against one another or arranged at distances from one another. The distance between the outer edges of the neighboring head curves can be composed of the double wire diameter or the double wire width of the head curves, the diameter of the insertion wire, and the play between the head curve and the insertion wire permitting a hinge action.

It is advantageous when the in edge mounts of the endless sieve band or composite band of the invention ears or shackles are used for insertion of dowels. Advantageously, such bands use insertion wires of steel wire, so that the bands, via the dowels, can more or less spread for varying, for example, its air permeability. Without changing the main idea of the present invention, the insertion wire of this embodiment can be composed of a synthetic plastic material. Because of the elasticity of the individual helixes, the band can be narrowed to its initial length, when required.

For obtaining the same effect, the edge mounts of many bands can be provided with reinforcement for engaging of pulling claws.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

BRIEF DESCRIPTION OF THE DRAWING

FIG. 6 is a view showing a section taken along the line VI—VI in FIG. 2;

FIG. 7 is a view showing a section taken along the line VII—VII in FIG. 3;

FIG. 9 is a partial section taken through the band, taken along the line IX—IX in FIG. 10; and FIG. 10 is a view showing a fragment of the construction of the band.

DESCRIPTION OF THE PREFERRED EMBODIMENTS

Figure 1:
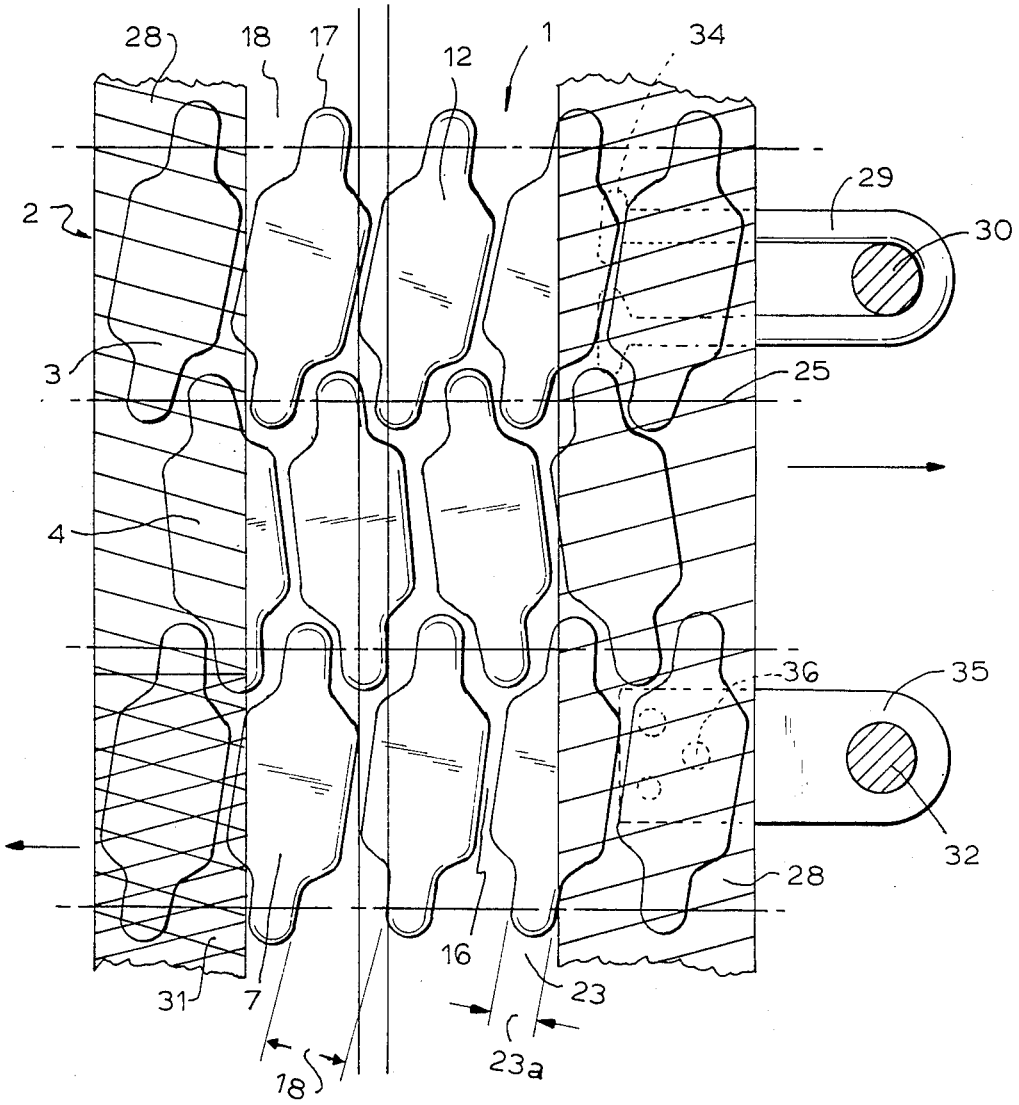
FIG. 1 is a plan view schematically showing an endless sieve band or composite band in accordance with the present invention.

FIG. 1 shows a schematic view of an endless sieve band or composite band which is partially sectioned and identified as a whole with reference numeral 1. The band, shown only in cut out, can have any length and also any width. Both vertical lines in the center of FIG. 1 schematically illustrate this.

The band includes individual helixes 2 which can extend to the right as helixes 3 or to the left as helixes 4. Neighboring helixes can be produced from elastic synthetic plastic material or metallic wire, which is not germane for the present invention. They are composed, as shown in FIG. 10, of supporting winding legs 7 and opposite winding legs 8. The winding legs are connected with one another by head curves 17.

As can be seen from FIG. 1, intermediate spaces 18 remain between the individual head curves 17, and a head curve of the neighboring helix is introduced in the respective intermediate space. Therefore an overlapping region 24 is formed between two neighboring helixes, as can be seen from FIG. 8, and an insertion wire 25 is introduced into this intermediate region. The head curves 17 of the neighboring helixes form together with the insertion wire 25 a pivotable hinge-like connection.

The insertion wire 25 can be composed, similarly to the material of the helixes, of a synthetic plastic material or metal.

The winding legs 7, which in the plan view of FIG. 1 lie above and are supporting, has a flat supporting surface 12 with a width 13 which is greater than the diameter 23 of the wire or the width 23*a* of the wire of the head curves 17. The intermediate space 18 between the neighboring head curves 17 is greater than the wire diameter 23 or the wire width 23*a* of the head curves.

Figure 2:
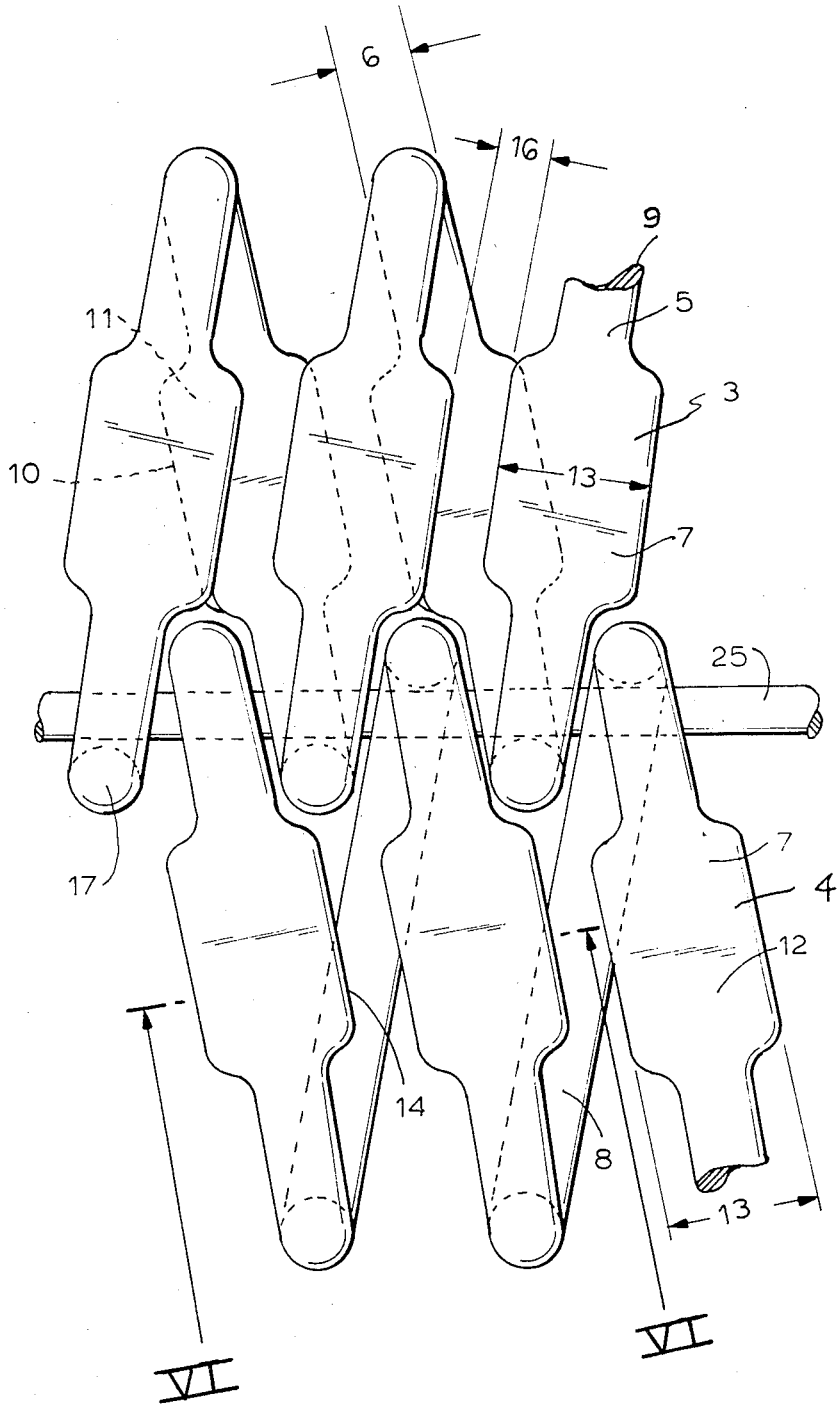
FIG. 2 is a plan view of the band in accordance with a further embodiment of the present invention.

As can be seen from FIG. 2, the winding leg 8, which lies under the supporting winding leg 7 opposite thereto, can have a round cross section 9*b* or a triangular cross section contrary to the supporting surface 12.

In accordance with a further embodiment of the present invention, the oppositely located winding leg 10 can have a rectangle-like cross section 11. As shown in FIG. 2, the oppositely located winding leg 10 can also have a rectangular cross section 11. As can further be seen from FIG. 2, the wire from which the helixes 3 and 4 are formed is an elastic synthetic plastic wire or a metal wire 5 with a diameter 6 which in several embodiments of the present invention is substantially equal to the diameter of the head curves 17.

The opposite located winding leg 10 can have in some embodiments of the invention plain supporting surfaces 12. The plane supporting surfaces 12 have a width 13 and edges 14 between which distances 16 are provided.

Figure 8:
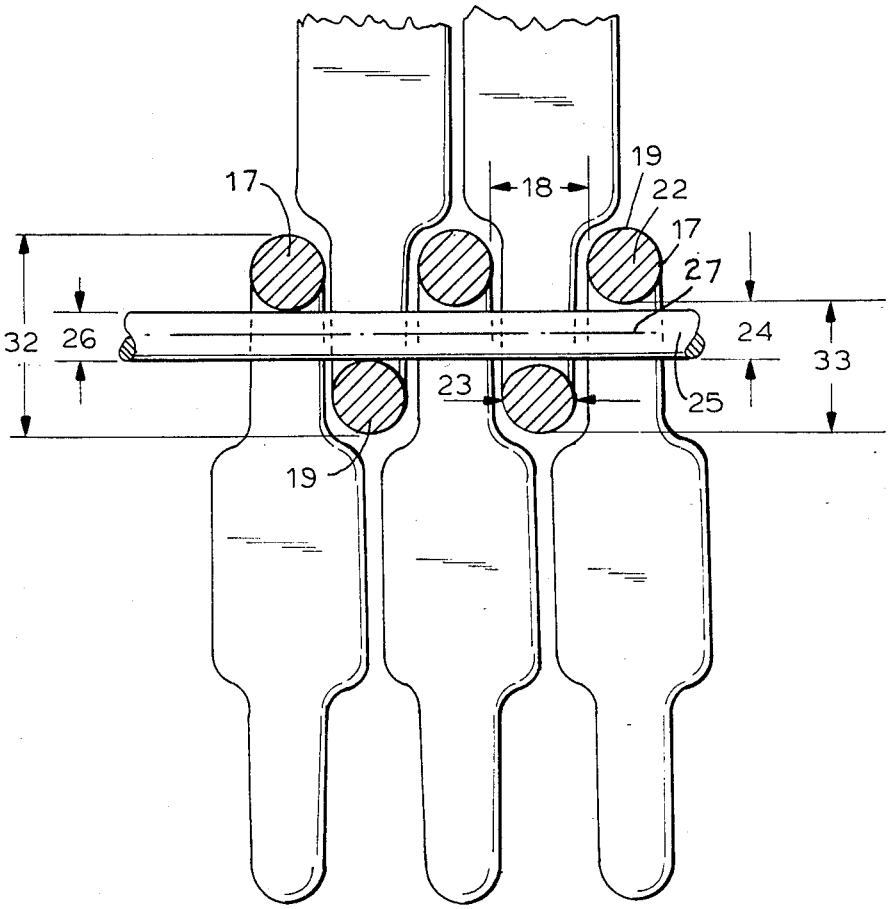
FIG. 8 is a view showing a partial section through the band of the invention.

The band shown in FIG. 2 is composed of left-sided and right-sided helixes 4 and 3. It can be seen that the head curves of the neighboring helixes basically do not abut against one another in the sequence of a helical spring-like tensioning. This is because the helixes 2, 3, 4 are wound with a spacing and have a pulling-spring tensioning such that the fixed intermediate spaces 18 between their head curves 17 are greater than their wire diameters 23 or their wire widths 23*a*. The wire 22 of the head curve 17, as shown in FIG. 8, of the helixes 2, 3, 4 can have a substantially round cross section 20, an oval cross section, a triangle-like cross section, or a rectangle-like cross section, which is squeezed relative to its original design in all cases, as can be seen from position 21 in FIG. 7. For providing a great variation breadth of the inventive band with respect to its supporting surface, air permeability, heat transfer and also its machine and manual manufacture, the width 13 of the plane supporting surfaces can be twice as great as the wire diameter 23 or the wire width 23*a* of the head curves 17. In accordance with another embodiment of the invention, the width 13 of the plane supporting surfaces 12 and the winding leg 7, 10 having the same is twice as great or greater than the wire diameter 23 or the wire width 23*a* of the head curves 17. The width ratio in each individual case depends on the purpose for which the inventive flat shaped article is to be used.

Figure 3:
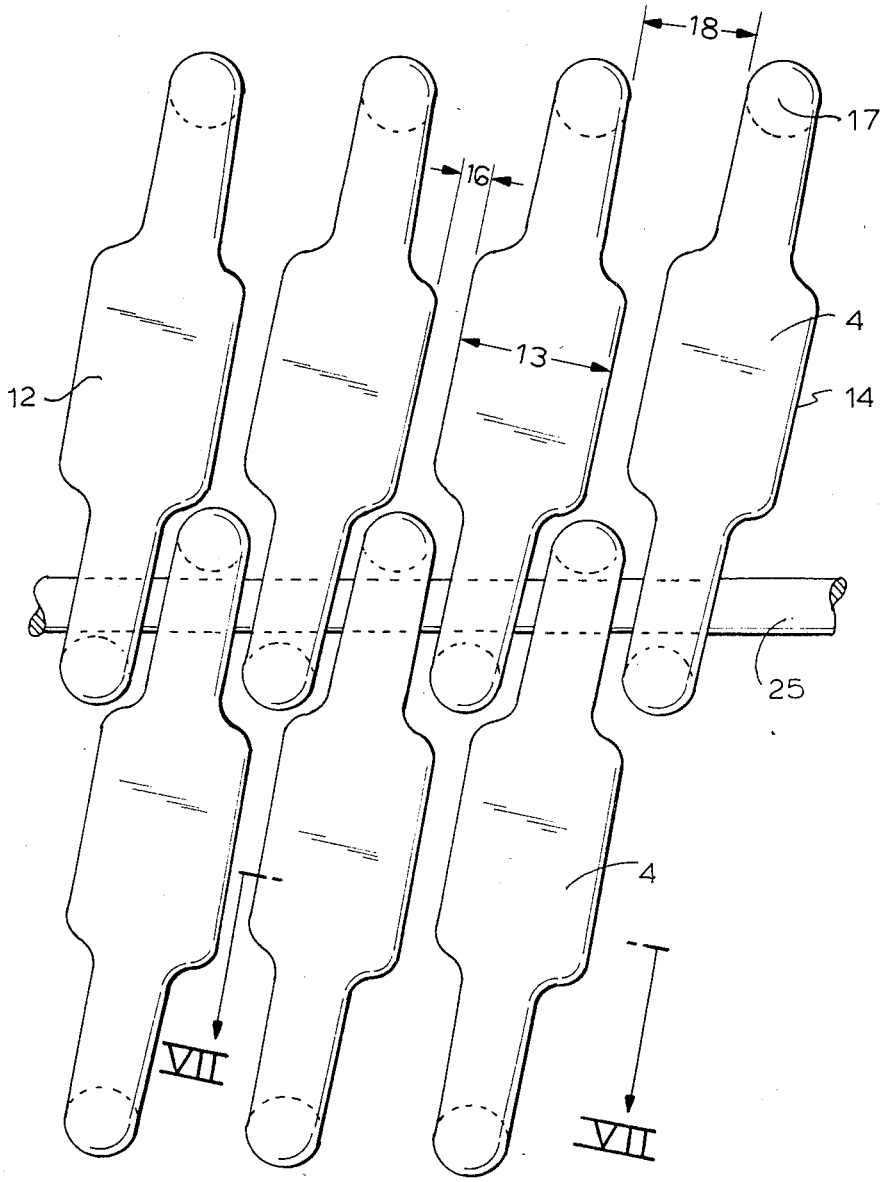
FIG. 3 is a plan view of the band in accordance with still a further embodiment of the present invention.
Figure 4:
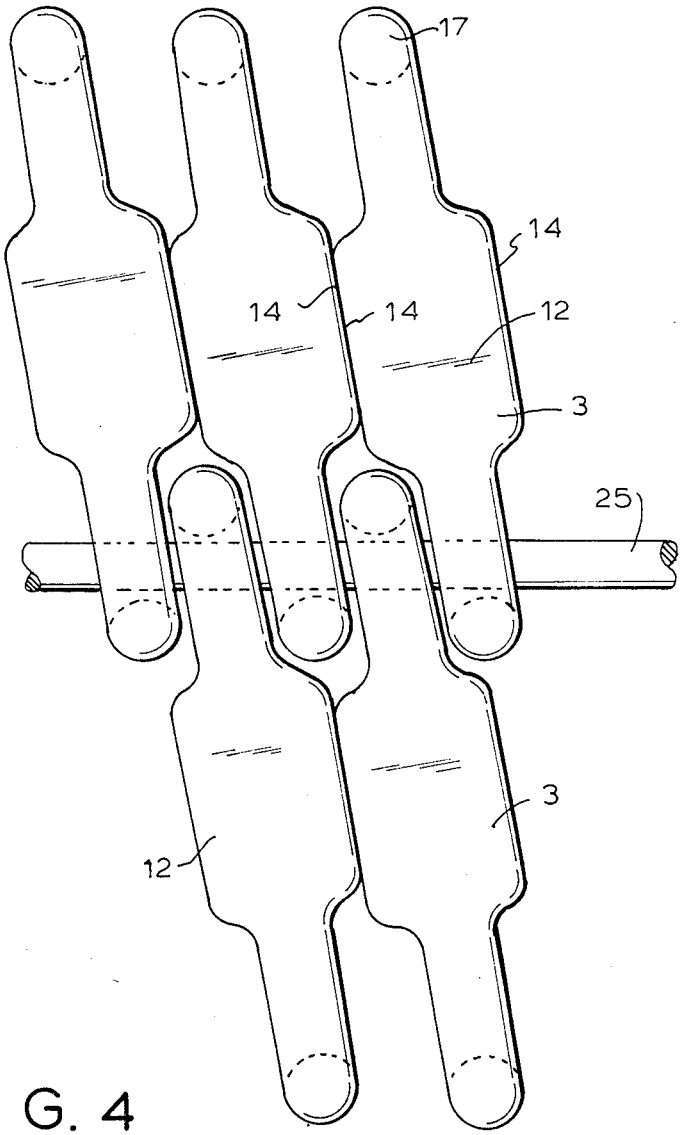
FIG. 4 is a plan view of the band in accordance with an additional embodiment of the present invention.

FIG. 3 shows an embodiment in which the inventive sieve band or composite band is composed of the helixes which are all left-sided helixes 4. Contrary to this, FIG. 4 shows an embodiment in which all helixes 2 are right-sided helixes 3. In the embodiment of FIG. 4, the edges 14 of the neighboring plane supporting surfaces 12 abut tightly against one another. In the embodiment of FIG. 3, the distances 16 remain between the edges 14 of the neibhboring supporting surfaces. By the selection of the width 13 of the plane supporting surfaces 12, and by the thereby required distances 16 between the plane supporting surfaces 12, the air stream which passes through the band, for example in paper production, can be varied.

Figure 5:
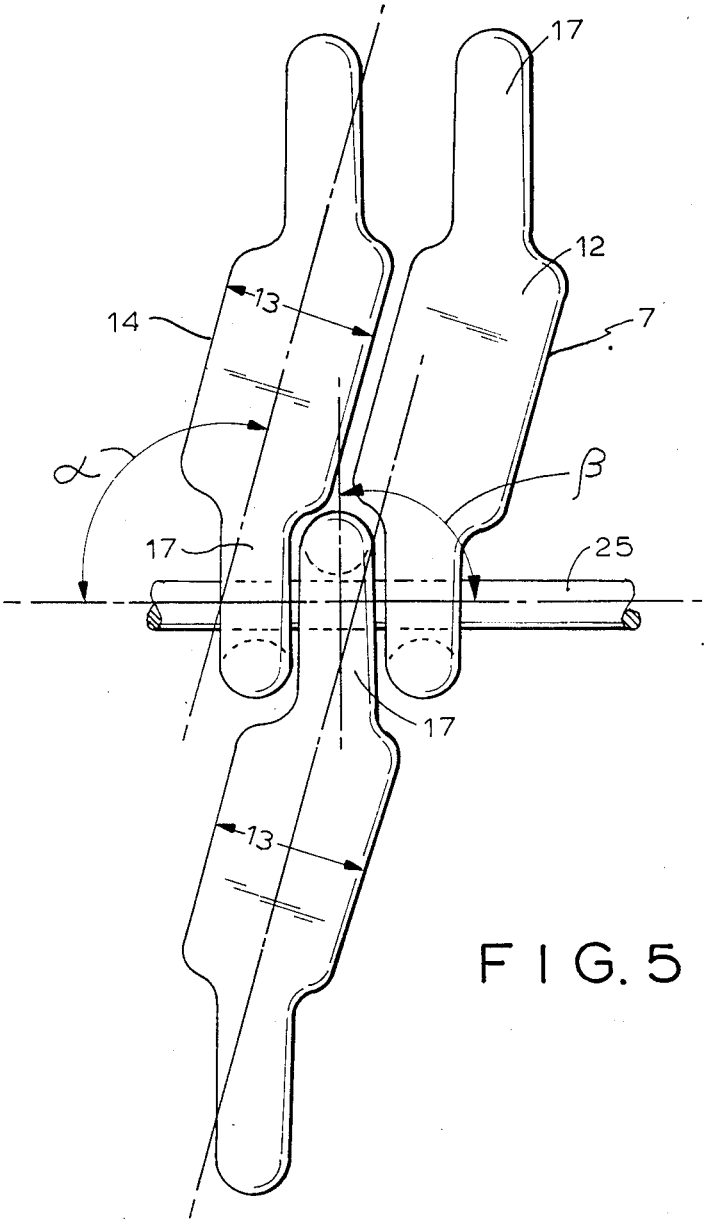
FIG. 5 is a plan view of an embodiment in which the winding leg and the head curve of the helixes have different orientations for insertion wire.

FIG. 5 shows an embodiment in which the winding leg 7 or the not shown opposite winding legs 8 and 10 forms with the insertion wire 25 an angle $\alpha$ which is different from 90°, wherein the head curves 17 of the helixes 2, 3, 4 form an angle $\beta$ which is substantially equal to 90°. In this embodiment of the band, the permeable surface for the air is provided with a smaller cross section than in the other embodiments.

FIGS. 6 and 7 illustrate in detail the dimensions of the individual helixes. FIG. 6 shows that the supporting winding legs 7 has an approximately rectangular-like cross section 11, whereby plane supporting surfaces 12 are formed. The width 13 of this supporting winding leg 7 is dimensioned in accordance with FIG. 6 so that a distance remains between the edges 14. This distance is fixed. The opposite winding leg 8 has a round cross section 20.

In the embodiment of FIG. 7, the supporting winding leg 7 and the oppositely located winding leg 10 both have the rectangular cross section 11. The head curve 17, contrary to this, have a squeezed cross section 21 which can be formed as an oval, triangle-like or rectangle-like basic cross section.

The schematic view of FIG. 8 also shows some details of the invention. The head curves 17 have outer edges 19. The total distance between these outer edges 19 is identified with reference numeral 32. It is formed by the double wire diameter 23 or the double wire width 23*a* of the head curves 17, the diameter 26 of the insertion wire 25, and a play 27 between the head curves 17 and the insertion wire 25. Because of this play, the hinge action between the neighboring helixes is possible.

The so-called overlapping region identified with reference numeral 24 in FIG. 8 is formed by the diameter 26 of the insertion wire 25 and the play 27 between the insertion wire 25 and the head curves 17. The distance between the inner edge of a head curve and the outer edge of the opposite head curve is identified with reference numeral 33.

FIGS. 9 and 10 show further details of the band with cross sections 11′ of the head curves 17 which are rectangle-like, and cross sections 9*a* and 9*b* which are oval or triangle-like. The selection of the wire or the cross section of the head curve in each individual case depends upon the desired application of the band. In accordance with FIG. 10, the head curve 17 is somewhat squeezed during the manufacture of the helixes. With a subsequent fixing of the helixes, they have in many embodiments the oval design of FIG. 10.

From FIG. 1 it can be seen that edge mounts 28 are necessary to fix the width of the band over a long service life. At the right side of FIG. 1, ears 29 and dowels 30 are shown, whereas at the left side of FIG. 1 reinforcing elements 31 in the edge mounts 28 can be provided. With the aid of the dowels 30, the bands can be spread first of all when the insertion wire 25 is composed of metal, if required. Thereby the air permeability through the band can be varied as desired. For providing a reliable holding of the ears 29 in the edge mount regions, barbs 34 are provided. Shackles 35 in which dowels for spreading the band during operation can be introduced, have safety openings 36 to guarantee the reliable seating inside the edge mounts 28 of synthetic plastic material.

It will be understood that each of the elements described above, or two or more together, may also find a useful application in other types of constructions differing from the types described above.

While the invention has been illustrated and described as embodied in a flat shaped article, particularly a sieve band or composite band for paper machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An endless sieve band or composite band for paper machines, comprising a plurality of helixes composed of an elastic wire and each having opposite winding legs and also head curves, said head curves connecting said winding legs with one another and having a predetermined wire diameter, a wire width and an intermediate space between said head curves, said helixes being arranged so that when the head curves of one of two neighboring helixes are inserted into the intermediate spaces of another of the two neighboring helixes an overlapping region is formed, said winding legs of each of said helixes including supporting winding legs which have a flat supporting surface with a width exceeding the wire width of said head curves, said supporting surfaces of said supporting winding legs of each of said helixes being spaced from one another by a distance which is smaller than said intermediate space between said head curves; and a plurality of insertion wires each inserted in said overlapping region of the neighboring helixes.

2. An endless sieve band or composite band as defined in claim 1, wherein said elastic wire of which said helixes are composed is of a material selected from the group consisting of an elastic synthetic plastic wire and an elastic metal wire.

3. An endless sieve band or composite band as defined in claim 1, wherein said elastic wire of which said insertion wires are composed is of a material selected from the group consisting of an elastic synthetic plastic wire and an elastic metal wire.

4. An endless sieve band or composite band as defined in claim 1, wherein other winding legs of each of said helixes which are opposite to said supporting winding legs have a flat supporting surface and a round cross section.

5. A flat shapped article as defined in claim 4, wherein said supporting winding legs and the other winding legs which are opposite to said supporting winding legs of each of said helixes have substantially rectangle-like cross sections.

6. An endless sieve band or composite band as defined in claim 1, wherein the wire of said head curves of said helixes has a cross section squeezed relative to its initial design, at least said supporting winding legs of each of said helixes having a substantially rectangle-like cross section.

7. An endless sieve band or composite band as defined in claim 6, wherein said cross section of said head curves of said helixes has a round shape.

8. An endless sieve band or composite band as defined in claim 1, wherein the width of said supporting winding legs having the flat supporting surfaces is double the wire width of said head curves.

9. An endless sieve band or composite band as defined in claim 4, wherein the width of said winding legs having the flat supporting surfaces is double the wire width of said head curves.

10. An endless sieve band or composite band as defined in claim 1, wherein the width of said supporting winding legs having the flat supporting surfaces is more than double the wire width of said head curves.

11. An endless sieve band or composite band as defined in claim 4, wherein the width of said winding legs having the flat supporting surfaces is more than double the wire width of said head curves.

12. An endless sieve band or composite band as defined in claim 1, wherein said helixes of said plurality of helixes are wound with a predetermined spacing.

13. An endless sieve band or a composite band as defined in claim 1, wherein the intermediate space between said head curves is greater than the wire width thereof.

14. An endless sieve band or composite band as defined in claim 1, wherein said plurality of helixes includes alternately arranged left-side and right-side helixes.

15. An endless sieve band or composite band as defined in claim 1, wherein said plurality of helixes includes all right-side helixes.

16. An endless sieve band or composite band as defined in claim 1, wherein said plurality of helixes includes all left-side helixes.

17. An endless sieve band or composite band as defined in claim 1, wherein said supporting winding legs of each of said helixes form with said insertion wire an angle differing from 90°, whereas said head curves of each of said helixes form with the same an angle substantially corresponding to 90°.

18. An endless sieve band or composite band as defined in claim 1, wherein said supporting winding legs which have said flat supporting surfaces have edges abutting against one another.

19. An endless sieve band or composite band as defined in claim 4, wherein said winding legs which have said flat supporting surfaces have edges abutting against one another.

20. An endless sieve band or composite band as defined in claim 1, wherein said supporting winding legs which have said flat supporting surfaces have edges spaced from one another by predetermined distances.

21. An endless sieve band or composite band as defined in claim 1, wherein said winding legs which have said flat supporting surfaces have edges spaced from one another by predetermined distances.

22. An endless sieve band or composite band as defined in claim 1, wherein said head curves are spaced from one another by a distance which includes the double wire width of said head curves, the diameter of said insertion wire and a play between said head curves and said insertion wire which permits a hinge action.

23. An endless sieve band or composite band as defined in claim 1, wherein the other winding legs of each of said helixes which are opposite to said supporting winding legs have an oval cross section.

24. An endless sieve band or composite band as defined in claim 1, wherein the other winding legs of each of said helixes which are opposite to said supporting winding legs have a triangle-like cross section.

25. An endless sieve band or composite band as defined in claim 6, wherein said cross section of said head curves of said helixes has an oval shape.

26. An endless sieve band or composite band as defined in claim 6, wherein said cross section of said head curves of said helixes has a triangle-like shape.

27. A flat shaped article as defined in claim 6, wherein said cross section of said head curves of said helixes has a rectangle-like cross section.

28. An endless sieve band or a composite band as defined in claim 1, wherein said distance between said supporting surfaces is smaller than the wires width of said head curves.

29. An endless sieve band or a composite band as defined in claim 1, wherein the overlapping regions of each of said helixes are spaced from one another by a predetermined distance, said supporting surface having a length approximately equal to said distance between said overlapping regions.

* * * * *